US012529495B2

(12) United States Patent
Yamamoto

(10) Patent No.: US 12,529,495 B2
(45) Date of Patent: Jan. 20, 2026

(54) VENTILATION DEVICE AND VENTILATION SYSTEM

(71) Applicant: Panasonic Intellectual Property Management Co., Ltd., Osaka (JP)

(72) Inventor: Naotake Yamamoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 312 days.

(21) Appl. No.: 18/275,686

(22) PCT Filed: Feb. 15, 2021

(86) PCT No.: PCT/JP2021/005559
§ 371 (c)(1),
(2) Date: Aug. 3, 2023

(87) PCT Pub. No.: WO2022/172460
PCT Pub. Date: Aug. 18, 2022

(65) Prior Publication Data

US 2024/0133582 A1 Apr. 25, 2024
US 2024/0230149 A9 Jul. 11, 2024

(51) Int. Cl.
*F24F 13/20* (2006.01)
*F24F 7/06* (2006.01)
*F24F 7/00* (2021.01)

(52) U.S. Cl.
CPC ..... *F24F 13/20* (2013.01); *F24F 7/06* (2013.01); *F24F 2007/001* (2013.01)

(58) Field of Classification Search
CPC ..... F24F 13/20; F24F 7/06; F24F 2007/001; F24F 11/56
(Continued)

(56) References Cited

U.S. PATENT DOCUMENTS 6,364,211 B1 * 4/2002 Saleh ..... F24F 11/76 236/51
7,908,879 B1 * 3/2011 Chen ..... F24F 1/0041 62/259.1
(Continued)

FOREIGN PATENT DOCUMENTS

JP 9-229439 A 9/1997
JP 9-318132 A 12/1997
(Continued)

OTHER PUBLICATIONS

Office Action issued in Japan Counterpart Patent Appl. No. 2019-206577, dated Jun. 27, 2023.
(Continued)

*Primary Examiner* — Avinash A Savani
*Assistant Examiner* — Ryan L Faulkner
(74) *Attorney, Agent, or Firm* — GREENBLUM & BERNSTEIN, P.L.C.

(57) ABSTRACT

When a main body case is viewed from below, an antenna is within a rectangular/square area defined by first to fourth points. An opening edge of a first opening includes: a first edge linearly along a first direction; and a second edge linearly along a second direction perpendicular to first direction, first point is defined as an intersection of a first straight line and a second straight line, first straight line includes first edge, and second straight line includes second edge. Second point is defined as a point apart from first point in first direction by a distance that is half prescribed wavelength. Third point is defined as a point apart from second point in second direction by a distance that is half prescribed wavelength. Fourth point is defined as a point apart from first point in second direction by a distance that is half prescribed wavelength.

8 Claims, 13 Drawing Sheets

(58) Field of Classification Search
USPC ..... 454/251
See application file for complete search history.

(56) References Cited

U.S. PATENT DOCUMENTS

| | | | | |
|---|---|---|---|---|
| 2014/0326794 | A1* | 11/2014 | Frank | F24F 11/523 236/51 |
| 2021/0231330 | A1* | 7/2021 | Stephens | F24F 11/38 |

FOREIGN PATENT DOCUMENTS

| | | | |
|---|---|---|---|
| JP | 2000-199636 | A | 7/2000 |
| JP | 2006-336883 | A | 12/2006 |
| JP | 2018-54282 | A | 4/2018 |
| JP | 2018-105549 | A | 7/2018 |
| JP | 2019-47211 | A | 3/2019 |
| JP | 2019-158325 | A | 9/2019 |
| JP | 2021-81090 | A | 5/2021 |

OTHER PUBLICATIONS

International Search Report issued in International Patent Application No. PCT/JP2021/005559, dated Apr. 6, 2021, along with an English translation thereof.

* cited by examiner

VENTILATION DEVICE AND VENTILATION SYSTEM

CROSS-REFERENCE TO RELATED APPLICATIONS

This application is a National Stage of International Application No. PCT/JP2021/005559 filed Feb. 15, 2021. The content of the above-identified application is incorporated herein by reference in its entirety.

TECHNICAL FIELD

The present disclosure generally relates to ventilation devices and ventilation systems. More particularly, the present disclosure relates to a ventilation device to be used for indoor ventilation, and a ventilation system including the ventilation device.

BACKGROUND ART

Patent Literature 1 discloses a ventilation device to be installed at a place such as a ceiling, of building. The ventilation device disclosed in Patent Literature 1 includes: a box-shaped casing including a bottom surface with a suction port and a side surface with an air outlet; and an air blower guiding air from the suction port to the air outlet. The material of the casing is metal.

In the technical field of the ventilation device, the user convenience is desired to be further improved.

CITATION LIST

Patent Literature

Patent Literature 1: JP 2019-158325 A

SUMMARY OF INVENTION

It is therefore an object of the present disclosure to provide a ventilation device and a ventilation system, all of which can realize performing wireless communication and further contribute to improving communication performance.

A ventilation device according to an aspect of the present disclosure includes a main body case, an air blowing unit, a wireless communications unit, and a controller. The main body case is made of metal. The main body case has a rectangular or square box shape, and includes a first opening and a second opening, the first opening is in a lower surface of the main body case, and the second opening is in a peripheral wall or an upper wall of the main body case. The air blowing unit is disposed in the main body case. The air blowing unit is configured to blow air between the first opening and the second opening. The wireless communications unit includes an antenna, and is configured to perform wireless communication by using a radio wave having a prescribed wavelength as a medium. The controller is connected to the wireless communications unit. The controller is configured to control the air blowing unit in accordance with a signal received by the wireless communications unit. When the main body case is viewed from below, the antenna is within a rectangular/square area defined by a first point, a second point, a third point and a fourth point, and is disposed apart from an opening edge of the first opening of the main body case. The opening edge of the first opening includes: a first edge linearly along a first direction; and a second edge linearly along a second direction perpendicular to the first direction, the first point is defined as an intersection of a first straight line and a second straight line, the first straight line includes the first edge, and the second straight line includes the second edge. The second point is defined as a point apart from the first point in the first direction by a distance that is half the prescribed wavelength. The third point is defined as a point apart from the second point in the second direction by a distance that is half the prescribed wavelength. The fourth point is defined as a point apart from the first point in the second direction by a distance that is half the prescribed wavelength.

A ventilation system according to an aspect of the present disclosure includes the ventilation device and an apparatus. The apparatus is configured to perform wireless communication with the wireless communications unit of the ventilation device.

DESCRIPTION OF EMBODIMENTS

FIGS. 1 to 4 and 10 to be referred to in the following embodiment or the like are all schematic representations. Thus, the ratio of the dimensions (including thicknesses) of respective constituent elements illustrated on the drawings does not always reflect their actual dimensional ratio.

Embodiment

Hereinafter, a ventilation device 1 according to an embodiment and a ventilation system 100 including the ventilation device 1 will be described with reference to FIGS. 1 to 6.

(1) Overview

The ventilation device 1 is attached to, for example, a ceiling of a bathroom, a toilet room or any other place in a residence. The installation location of the ventilation device 1 is not limited to buildings (single-family dwelling houses, multi-family dwelling houses, office buildings, commercial facilities, shops, factories, hospitals, art galleries, museums, amusement facilities, theme parks, airports, railway stations, dome stadiums, hotels, and the like). The installation location of the ventilation device 1 may be movers such as trains or vessels. The ventilation device 1 is configured to ventilate an indoor space by exhausting the indoor air outdoor.

Figure 1:
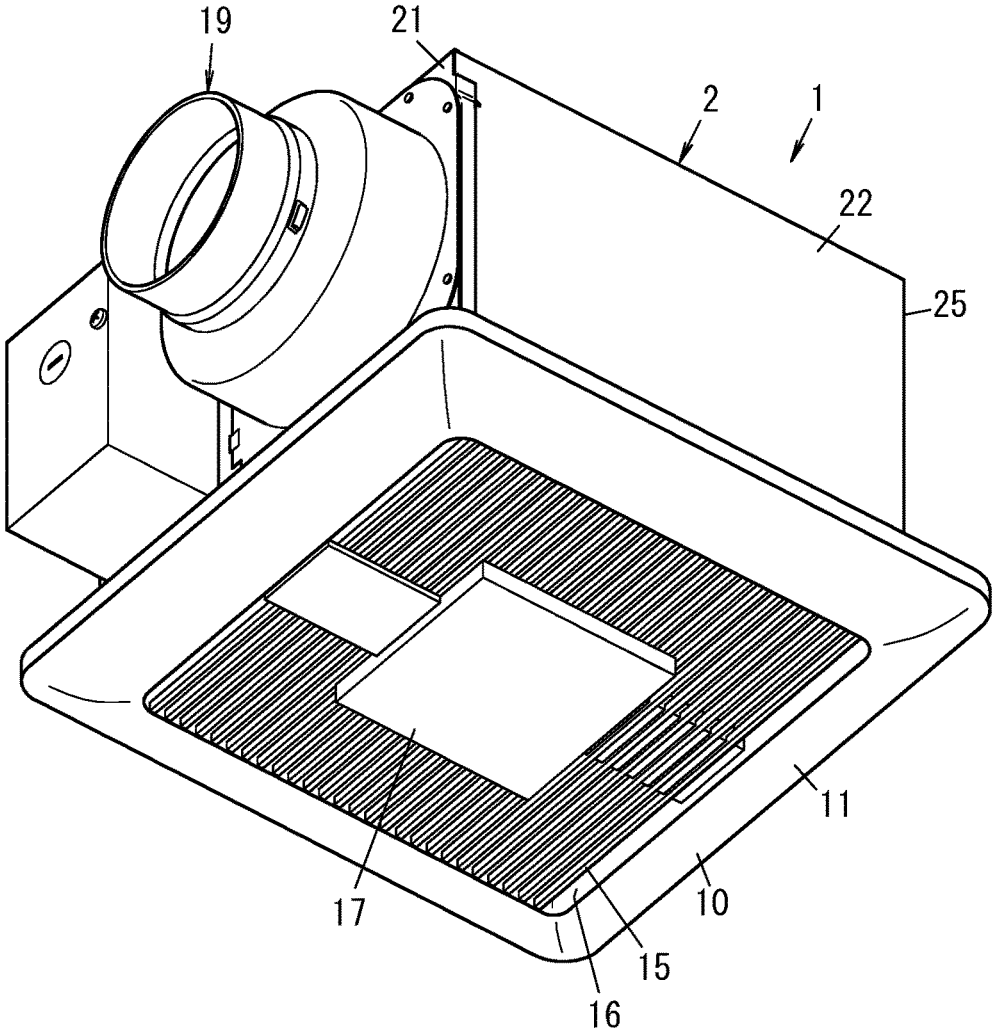
FIG. 1 is a perspective view of a ventilation device according to an exemplary embodiment.
Figure 2:
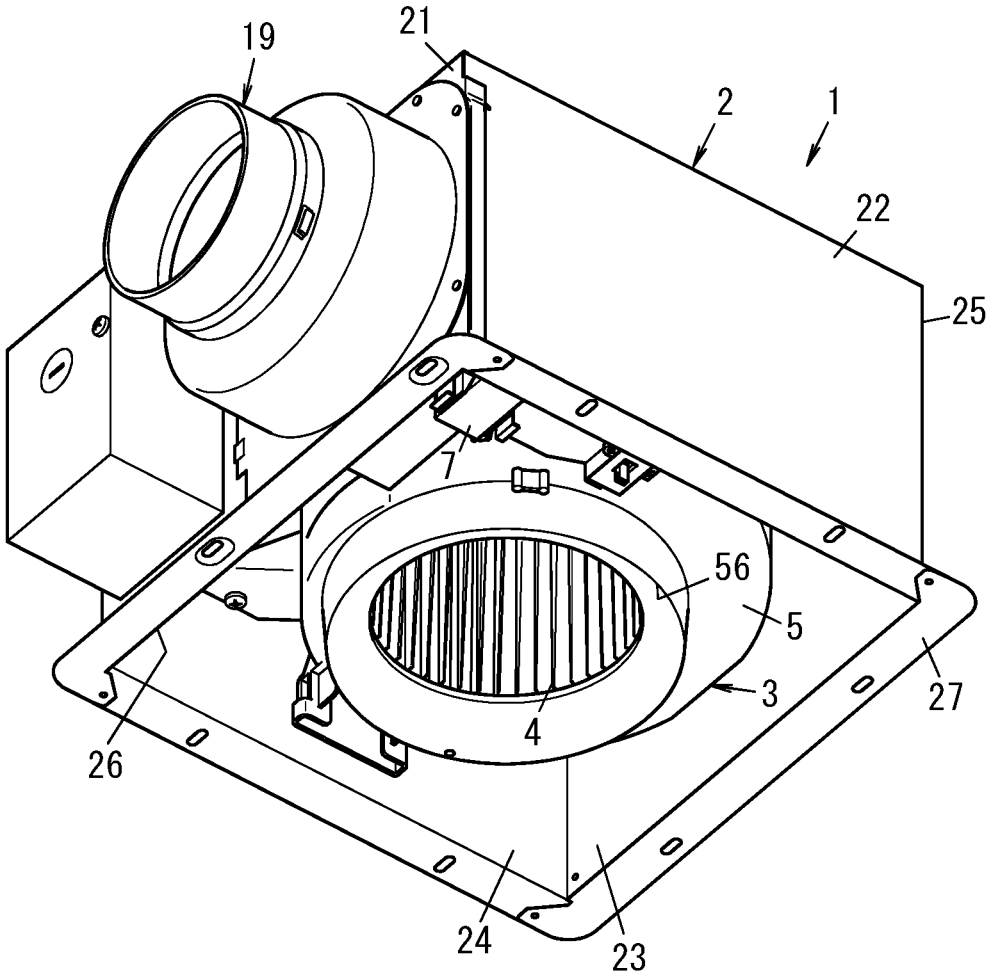
FIG. 2 is a perspective view of the ventilation device in a state where a cover thereof is removed.
Figure 3:
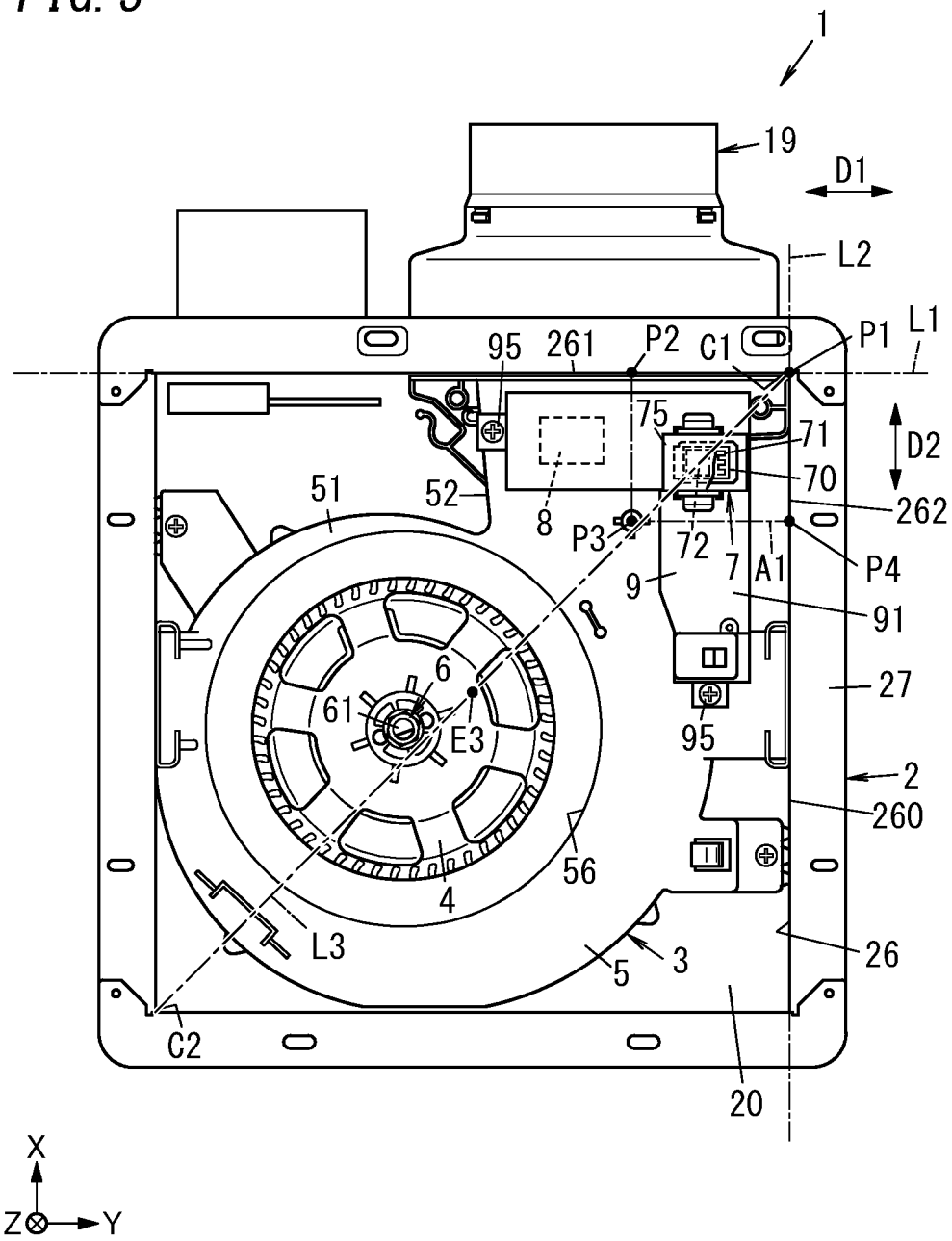
FIG. 3 is a bottom view of the ventilation device in the state where the cover is removed.

As shown in FIGS. 1 to 4, the ventilation device 1 includes a main body case 2, an air blowing unit 3, a wireless communications unit 7, and a controller 8 (refer to FIG. 3). The main body case 2 is made of metal. The main body case 2 has a rectangular or square box shape, and includes: a first opening 26 in a lower surface of the main body case 2; and a second opening 28 (refer to FIG. 4) in a peripheral wall 25 of the main body case 2. The air blowing unit 3 is disposed in the main body case 2. The air blowing unit 3 is configured to blow air between the first opening 26 and the second opening 28. The wireless communications unit 7 includes an antenna 71, and is configured to perform wireless communication by using a radio wave having a prescribed wavelength as a medium. The controller 8 is connected to the wireless communications unit 7. The controller 8 is configured to control the air blowing unit 3 in accordance with a signal received by the wireless communications unit 7.

Figure 6:
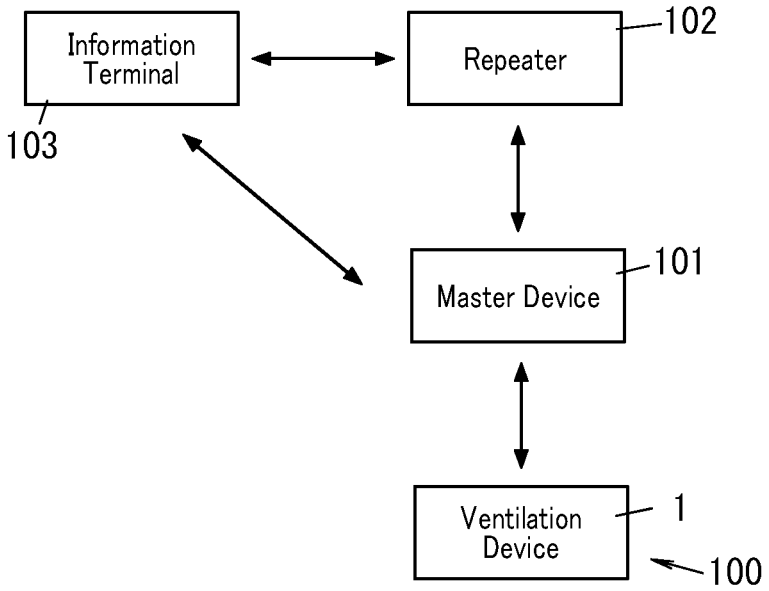
FIG. 6 is an explanatory diagram of a ventilation system including the ventilation device.

As shown in FIG. 6, the ventilation system 100 includes the ventilation device 1 and a master device 101 as an apparatus. The master device 101 is configured to perform wireless communication with the wireless communications unit 7 of the ventilation device 1. The ventilation system 100 may further include a repeater 102. In the case that the ventilation system 100 further includes the repeater 102, the ventilation device 1 is also configured to perform wireless communication with the repeater 102. The ventilation system 100 may further include an information terminal 103. In the case that the ventilation system 100 further includes the information terminal 103, the information terminal 103 is configured to perform wireless communication with the master device 101. The information terminal 103 is, for example, a mobile terminal to be carried by a user of the ventilation device 1 or any other person and is a communication terminal such as a smartphone. The information terminal 103 is not limited to a smartphone, and may be, for example, a tablet-type mobile terminal or a desktop-type computer.

(2) Detail

As described above, the ventilation device 1 includes the main body case 2, the air blowing unit 3, the wireless communications unit 7, and the controller 8. The ventilation device 1 further includes a duct connector 19. The ventilation device 1 further includes a cover 10.

The main body case 2 has a rectangular (or square) box shape and includes: a first opening 26 in a lower surface of the main body case 2; an upper wall 20 (refer to FIGS. 3 and 4); a peripheral wall 25; and a flange 27. The upper wall 20 has a rectangular (or square) plate shape. In this embodiment, the upper wall 20 has a square shape but should not be construed as limiting. Alternatively, the upper wall 20 may have a rectangular shape. The peripheral wall 25 is protruded downwardly from the whole circumference of the outer periphery of the upper wall 20. The peripheral wall 25 has a rectangular (or square) frame shape. The peripheral wall 25 includes a first side wall 21, a second side wall 22, a third side wall 23, and a fourth side wall 24. The first opening 26 is a rectangular (or square) shaped opening (in this embodiment, a square shaped opening) surrounded by a lower end of the first side wall 21, a lower end of the second side wall 22, a lower end of the third side wall 23 and a lower end of the fourth side wall 24. The second opening 28 (refer to FIG. 4) is provided in the first side wall 21 of the peripheral wall 25. In this embodiment, the second opening 28 is provided in a region closer to one end on the first side wall 21 (in FIG. 2, the region closer to the second side wall 22 on the first side wall 21; in FIG. 3, the right region on the first side wall 21) in a circumferential direction of the peripheral wall 25. The flange 27 is provided to extend laterally from the whole of the lower end of the peripheral wall 25 in the circumferential direction thereof.

When the ventilation device 1 is constructed, for example, the main body case 2 is inserted into an opening 201 provided in a ceiling material 200 (refer to FIG. 4) from below, and the flange 27 of the main body case 2 is brought into contact with a lower surface of the ceiling material 200 to be fixed to a part around the opening 201, of the ceiling material 200. Accordingly, most of the main body case 2 is arranged to protrude upwardly from the ceiling material 200.

As shown in FIGS. 2 and 3, the air blowing unit 3 includes a fan 4, a fan case 5, and a motor 6. The fan case 5 is made of resin. The fan case 5 includes: a third opening 56 connected to the first opening 26; and a fourth opening 58 (refer to FIG. 4) connected to the second opening 28. The fan 4 is disposed in the fan case 5. The motor 6 includes a rotary shaft 61, and is despised to rotate the fan 4 together with the rotary shaft 61.

The material of the fan 4 is resin (e.g., polypropylene). The fan 4 is a centrifugal fan (sirocco fan).

Figure 4:
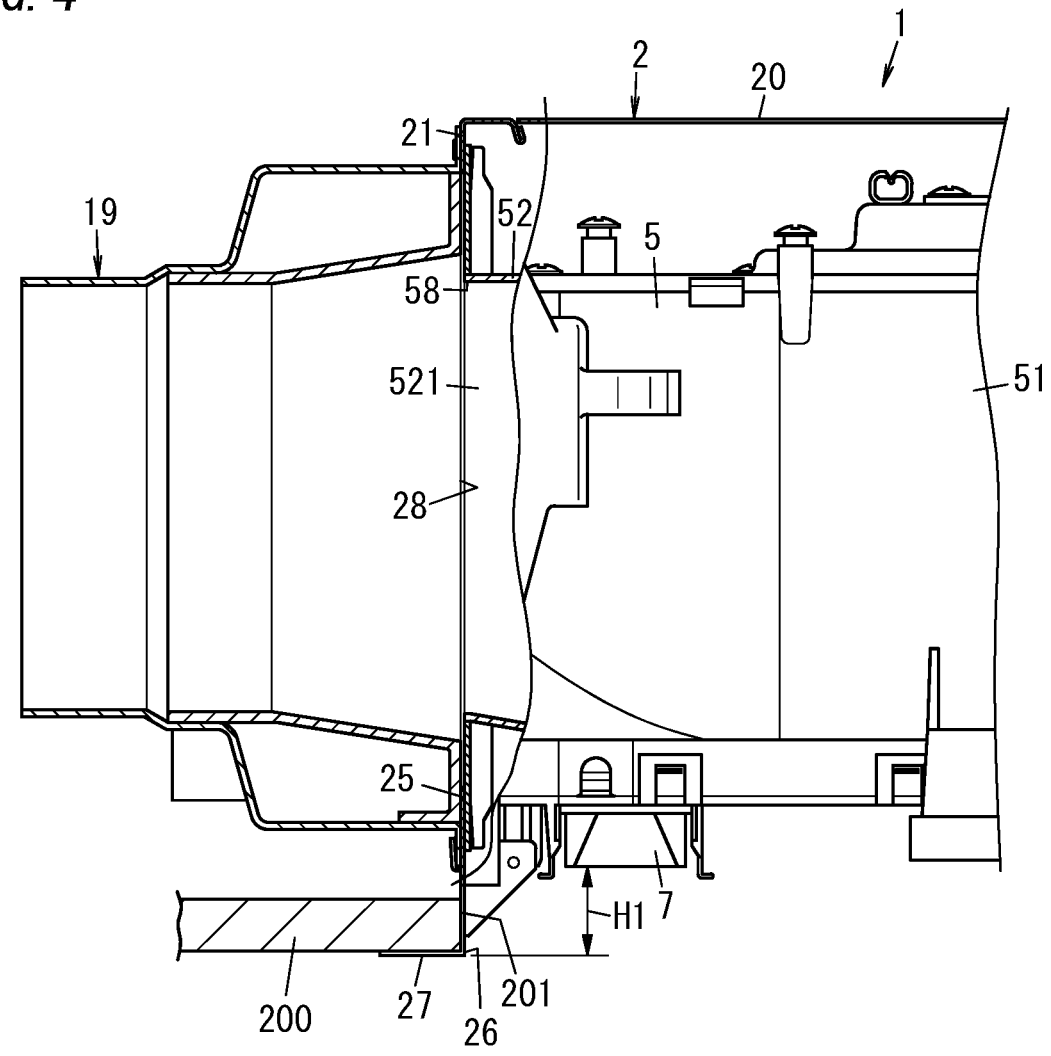
FIG. 4 is a side view of a main part partially broken, of the ventilation device.
Figure 5:
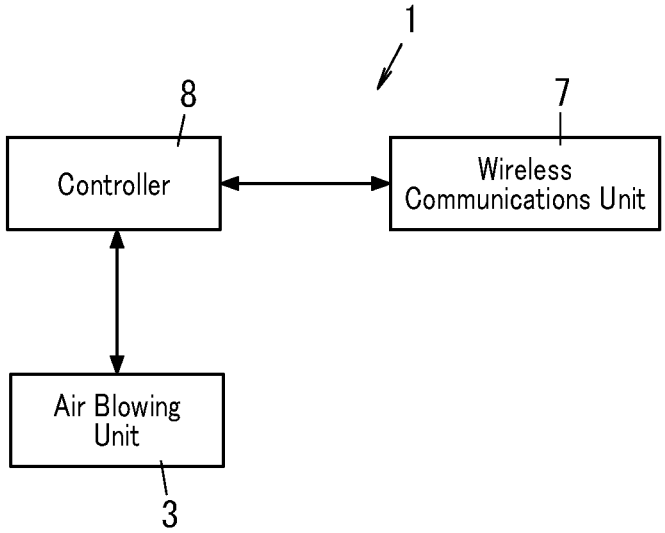
FIG. 5 is a block diagram of the ventilation device.

The material of the fan case 5 is resin (e.g., polypropylene). The fan case 5 is attached to the main body case 2. As shown in FIGS. 3 and 4, the fan case 5 includes a main body 51 and an extension 52. The main body 51 has the third opening 56 described above, in a lower surface of the main body 51. The outer circumferential shape of the main body 51 is generally circular. The opening shape of the third opening 56 is circular. The center of the third opening 56 is disposed to be eccentric from the center of the main body 51. The main body 51 has a first inner space to accommodate therein the fan 4 and the motor 6. The extension 52 is provided to extend from the main body 51 toward the first side wall 21. The extension 52 has a first end on the side of the main body 51 and a second end opposite to the first end, and the second end is attached to a part around the second opening 28, of the first side wall 21 of the main body case 2. The extension 52 has a second inner space 521 (refer to FIG. 4) connected to the first inner space. The air blowing unit 3 has a flow channel including the first inner space and the second inner space 521. The third opening 56 is provided as an inlet and the fourth opening 58 is provided as an outlet.

The air blowing unit 3 is configured to suck air from the first opening 26 of the main body case 2 and the third opening 56 of the main body 51 of the fan case 5 and blow the air thus sucked to the second opening 28 of the main body case 2 through the fourth opening 58.

In the ventilation device 1, the duct connector 19 is disposed on an outer surface of the first side wall 21. The duct connector 19 has a tubular shape and has an inner space connected to the second opening 28. The duct connector 19 is made of metal, for example. To the duct connector 19, a duct (e.g., an exhaust duct) is connected.

In the ventilation device 1, the cover 10 is disposed to cover the first opening 26 of the main body case 2. The cover 10 includes: a cover body 11 having a vent opening 16; a central portion 17 shaped like a rectangular plate; and a louver 15. The central portion 17 and the louver 15 are disposed to the vent opening 16 of the cover body 11. In the cover 10, the cover body 11 is attached to the flange 27 of the main body case 2 to cover the flange 27 of the main body case 2. The cover 10 may be provided such that the louver 15 is disposed even at a space where the central portion 17 is disposed.

The ventilation device 1 has a flow channel passing through the vent opening 16 of the cover 10, the first opening 26 of the main body case 2, the third opening 56 of the air blowing unit 3, the fourth opening 58 of the air blowing unit 3, the second opening 28 of the main body case 2, and the duct connector 19.

The controller 8 of the ventilation device 1 is configured to start operating of the air blowing unit 3, stop operating of the air blowing unit 3, or change the air volume of the air blowing unit 3 in accordance with contents included in a signal received from the master device 101 by the wireless communications unit 7. The ventilation device 1 is configured to change the air volume to be switched between two or more stages (in this embodiment, two stages) and operate in either a normal operation mode with a relatively low air volume or a high operation mode with a relatively high air volume. That is to say, the operation mode of the ventilation device 1 includes the normal operation mode and the high operation mode.

The controller 8 is electrically connected to the wireless communications unit 7. The controller 8 is electrically connected to the motor 6 of the air blowing unit 3. The controller 8 is configured to control the air blowing unit 3 in accordance with the signal received from the master device 101 by the wireless communications unit 7. The ventilation device 1 further includes a power supply circuit that is connected to an external power supply to supply a voltage to the controller 8.

The controller 8 allows the motor 6 of the air blowing unit 3 to operate, for example, when finding that the signal received from the master device 101 by the wireless communications unit 7 is a signal indicating starting of the operation of the ventilation device 1. In case that the ventilation device 1 is configured to operate in any one selected from a plurality of operation modes (e.g., a high operation mode, an intermediate operation mode, or a low operation mode) as the operation mode, when finding that the signal received from the master device 101 by the wireless communications unit 7 is a signal indicating a request for transmission of information about the operation state of the air blowing unit 3, the controller 8 transmits the information about the operation state of the air blowing unit 3 to the master device 101 by wireless communication. When finding that the signal received from the master device 101 by the wireless communications unit 7 is a signal indicating stopping of the operation of the ventilation device 1, the controller 8 allows the motor 6 of the air blowing unit 3 to stop.

Also, the operation of the controller 8 is set, for example, in response to that the user operates the information terminal 103 (refer to FIG. 6). The wireless communications unit of the information terminal 103 is set through the repeater 102 (refer to FIG. 6), the master device 101 (refer to FIG. 6), and the wireless communications unit 7. In the ventilation system 100, the communication method of the wireless communications unit of the information terminal 103 is Wi-Fi (registered trademark), and the repeater 102 is implemented as a router compatible with Wi-Fi (registered trademark). The communication method between the information terminal 103 and the repeater 102 is not limited to Wi-Fi (registered trademark), but may be a communication method conforming to, for example, the standard of Bluetooth (registered trademark) Low Energy, or Ethernet (registered trademark). The repeater 102 is not limited to the router compatible with Wi-Fi (registered trademark) as long as the repeater 102 can perform the wireless communication with the information terminal 103. The communication method between the repeater 102 and the master device 101 may be a wireless communication method or a wired communication method.

The controller 8 may be configured as a microcomputer including a processor and a memory. That is to say, the controller 8 may be implemented as a computer system including the processor and the memory. The computer system functions as the controller 8 by the processor executing an appropriate program. The program may be stored in advance in the memory. Alternatively, the program may also be downloaded via a telecommunications network such as the Internet or distributed after having been stored in a non-transitory storage medium such as a memory card.

The wireless communications unit 7 includes a printed board 70, an antenna 71, a Radio Frequency Integrated Circuit (RFIC) 72, and a matching circuit.

The matching circuit is provided between the antenna 71 and the RFIC 72. The outer circumferential shape of the printed board 70 is rectangular, when viewed in a thickness direction of the printed board 70. The printed board 70 has a first principal surface (surface) and a second principal surface (back surface), each of which intersects with the thickness direction of the printed board 70. The antenna 71 is implemented as, for example, a meander-shaped radiation conductor (a patterned conductor) provided at one end of the printed board 70 in a longitudinal direction thereof on the first principal surface of the printed board 70. The antenna 71 is disposed apart from an outer periphery of the printed board 70. The RFIC 72 is mounted on the first principal surface of the printed board 70. The matching circuit is a circuit for matching the impedance of the antenna 71 side with the impedance of the RFIC 72 side.

The wireless communications unit 7 is disposed in the main body case 2. The layout of the wireless communications unit 7 in the main body case 2 will be described later.

The wireless communications unit 7 further includes a first connector for external connection, disposed on the second principal surface of the printed board 70. The wireless communications unit 7 further includes a module cover 75. The module cover 75 houses therein a wireless communication module including the printed board 70, the antenna 71, and the RFIC 72. The material of the module cover 75 is resin. FIG. 3 shows the module cover 75 partially broken. In FIG. 3, a resist layer covering the antenna 71 on the printed board 70 is not shown.

The wireless communications unit 7 is configured to perform wireless communication by using a radio wave having a prescribed wavelength as a medium. The communication method of the wireless communications unit 7 is, for example, Zigbee (registered trademark) of the wireless communication standard. The wireless communications unit 7 uses any one channel selected from 16 channels in a frequency band of, for example, 2.4 GHz as the prescribed wavelength. Accordingly, when the wireless communications unit 7 uses, for example, a channel with a center frequency of 2.405 GHz that is the lowest center frequency in the center frequencies of the 16 channels, the prescribed wavelength is about 125 mm. When the wireless communications unit 7 uses, for example, a channel with a center frequency of 2.48 GHz that is the highest center frequency in the center frequencies of the 16 channels, the prescribed wavelength is about 120 mm. The wireless communication standard of the wireless communications unit 7 is not limited to Zigbee (registered trademark), but may be, for example, Wi-Fi (registered trademark), Bluetooth (registered trademark), Bluetooth (registered trademark) Low Energy, or specific low-power radio.

The ventilation device 1 includes a circuit module including the controller 8 (refer to FIG. 3). The circuit module includes the controller 8, a second connector, and a mother board on which the controller 8 and the second connector are mounted. In the ventilation device 1, the wireless communications unit 7 is electrically connected to the controller 8 by connecting the first connector of the wireless communications unit 7 to the second connector of the circuit module.

The ventilation device 1 further includes a holding member 9 holding the circuit module. The holding member 9 holds the controller 8 and the wireless communications unit 7. The holding member 9 includes a body made of synthetic resin and a cover made of synthetic resin. The holding member 9 is configured by coupling the body and the cover. while the circuit module is housed in a space surrounded by the body and the cover. The second connector is exposed, while the circuit module is housed in the space. The holding member 9 is attached to the fan case 5 on the lower side of the fan case 5 of the air blowing unit 3. The holding member 9 is L-shaped when viewed from the lower side of the main body case 2. The holding member 9 is attached to the extension 52 of the fan case 5 of the air blowing unit 3 by screwing a plurality of screws 95 or any other manner.

(3) Layout of Wireless Communications Unit in Main Body Case

The wireless communications unit 7 is disposed in the main body case 2 as described above. In this embodiment, as shown in FIG. 3, when the main body case 2 is viewed from below, the antenna 71 of the wireless communications unit 7 is within a rectangular/square area A1 defined by a first point P1, a second point P2, a third point P3, and a fourth point P4, and is disposed apart from an opening edge 260 of the first opening 26 of the main body case 2.

The opening edge 260 of the first opening 26 includes: a first edge 261 linearly along a first direction D1; and a second edge 262 linearly along a second direction D2 perpendicular to the first direction D1. The first point P1 is defined as an intersection of a first straight line L1 and a second straight line L2, the first straight line L1 includes the first edge 261, and the second straight line L2 includes the second edge 262.

The second point P2 is defined as a point apart from the first point P1 in the first direction D1 by a distance that is half the prescribed wavelength described above. As described above, when the wireless communications unit 7 performs the wireless communication by using a radio wave in the 2.4 GHz band as a medium, the prescribed wavelength is 120 mm or more and 125 mm or less. In the ventilation device 1 according to the embodiment, the distance that is half the prescribed wavelength is assumed to be 60 mm, but should not be construed as limiting. For example, the distance may be 62.5 mm.

The third point P3 is defined as a point apart from the second point P2 in the second direction D2 by a distance that is half the prescribed wavelength.

The fourth point P4 is defined as a point apart from the first point P1 in the second direction D2 by a distance that is half the prescribed wavelength.

Accordingly, the rectangular/square area A1 in the ventilation device 1 according to the embodiment is a square-shaped area having four sides each of which has a length of 60 mm.

In the ventilation device 1 according to the embodiment, the wireless communications unit 7 is arranged such that the first principal surface of the printed board 70 is positioned at the lower side and the second principal surface is positioned at the upper side.

In the ventilation device 1 according to the embodiment, when the main body case 2 is viewed from below, the rectangular/square area A1 is not overlapped with the main body 51 of the fan case 5 of the air blowing unit 3, but is partially overlapped with the extension 52.

In the ventilation device 1 according to the embodiment, the opening edge 260 of the first opening 26 includes: a first corner C1 including the first point P2; and a second corner C2 arranged diagonally to the first corner C1, and when the main body case 2 is viewed from below, the rotary shaft 61 of the motor 6 is disposed to be closer to the second corner C2 than a center E3 of a diagonal line L3 connecting the first corner C1 and the second corner C2 is. Accordingly, in the ventilation device 1, the fan case 5 of the air blowing unit 3 is compactly housed in the main body case 2. The main body case 2 of this embodiment has an installation space for installing the fan case 5 of the air blowing unit 3, and the installation space includes: a space of installing the main body 51 where the fan 4 is housed; and a space of installing the extension 52. The space of installing the main body 51 is set to be larger than the space of installing the extension 52. The center E3 of the diagonal line L3 is an intersection of the diagonal line L3 and a perpendicular bisector of the diagonal line L3.

In the ventilation device 1, when the main body case 2 is viewed from below, the holding member 9 is positioned to be closer to the first corner C1 than the center E3 of the diagonal line L3 is. Therefore, in the ventilation device 1, when the main body case 2 is viewed from below, the wireless communications unit 7 is positioned to be closer to the first corner C1 than the center E3 of the diagonal line L3 is. More specifically, when the main body case 2 is viewed from below, the wireless communications unit 7 is positioned between the main body 51 of the fan case 5 and the first corner C1, and is partially overlapped with the extension 52. In the ventilation device 1, when the main body case 2 is viewed from below, the holding member 9 is disposed along both the first edge 261 and the second edge 262, of the opening edge 260 of the first opening 26 of the main body case 2. In the ventilation device 1, when the main body case 2 is viewed from below, the holding member 9 is not overlapped with the cover body 11 and the central portion 17, of the cover 10.

The wireless communications unit 7 is disposed to face the first opening 26 of the lower surface of the main body case 2. Therefore, the wireless communications unit 7 faces the inner surface of the first side wall 21 of the main body case 2 in the second direction D2 and further faces the inner surface of the second side wall 22 of the main body case 2 in the first direction D1. A height H1 (refer to FIG. 4) from a virtual plane including the lower surface of the main body case 2 to the wireless communications unit 7 is set to be, for example, one-fourth of the prescribed wavelength, but should not be construed as limiting. The one-fourth of the prescribed wavelength is, for example, 30 mm.

(4) Communication Performance of Wireless Communications Unit in Ventilation Device Hereinafter, to explain the communication performance of the wireless communications unit 7 of the ventilation device 1 according to the embodiment, as an example, the right-hand system rectangular coordinates are defined with respect to the antenna 71 of the wireless communications unit 7, as shown in the lower left of FIG. 3. The right-hand system rectangular coordinates have three axes of an X-axis, a Y-axis, and a Z-axis, which are orthogonal to one another. The origin of the rectangular coordinates is defined as an end of the antenna 71. In FIG. 3, one direction along the upward direction of FIG. 3 in the second direction D2, is defined as a positive direction of the X-axis. Also in FIG. 3, one direction along the right direction of FIG. 3 in the first direction D1, is defined as a positive direction of the Y-axis. Also in FIG. 3, a direction along the depth direction of the paper plane of FIG. 3 is defined as a positive direction of the Z-axis. The X-axis, Y-axis, and Z-axis are all virtual axes, and the arrows representing "X," "Y," and "Z" in FIG. 3 are illustrated merely for convenience of explanation and have no entity. The positive direction of the Z-axis corresponds to the upward direction of the ventilation device 1 when the ventilation device 1 is installed to the ceiling material 200, for example. A negative direction of the Z-axis corresponds to the downward direction of the ventilation device 1 when the ventilation device 1 is installed to the ceiling material 200, for example. The positive direction of the X-axis and the positive direction of the Y-axis are not intended to be limited to specific directions when the ventilation device 1 is installed to the ceiling material 200, for example.

Figure 8:
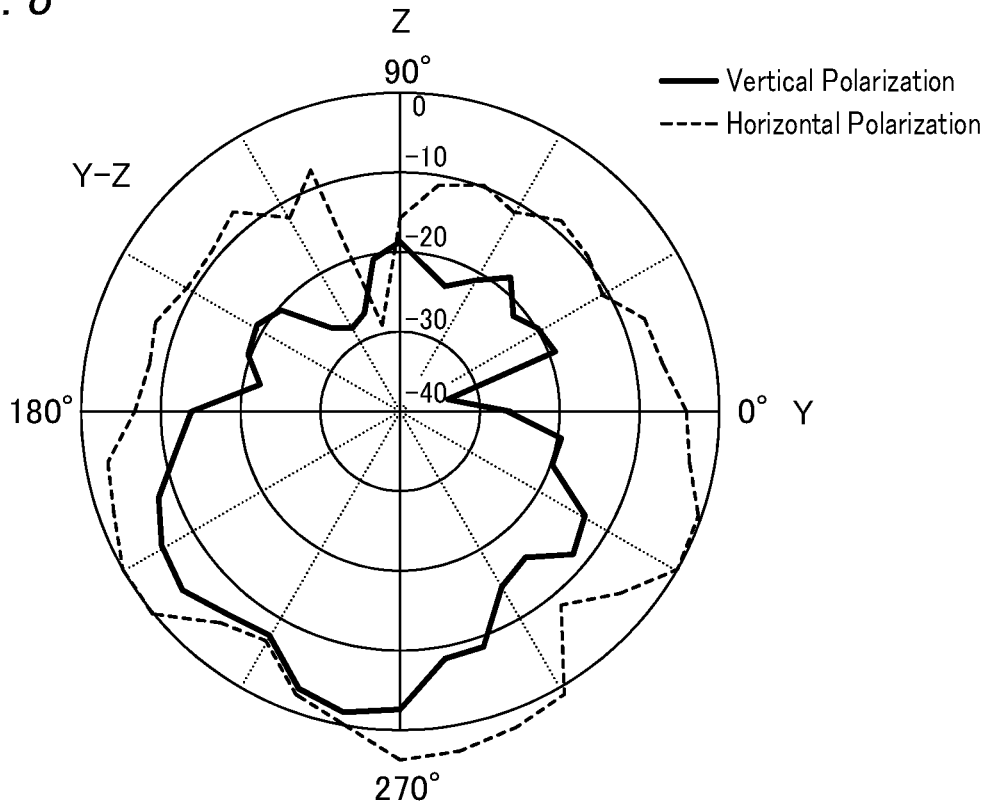
FIG. 8 is a characteristic diagram in Y-Z directions, of the wireless communications unit of the ventilation device.
Figure 9:
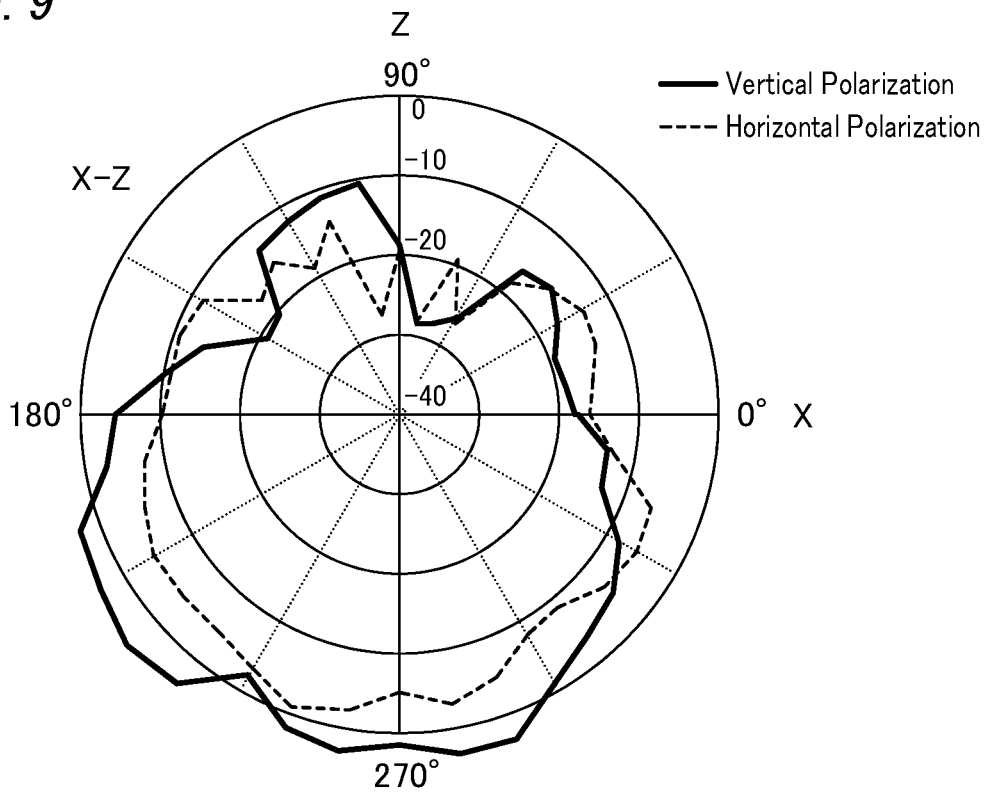
FIG. 9 is a characteristic diagram in X-Z directions, of the wireless communications unit of the ventilation device.
Figure 10:
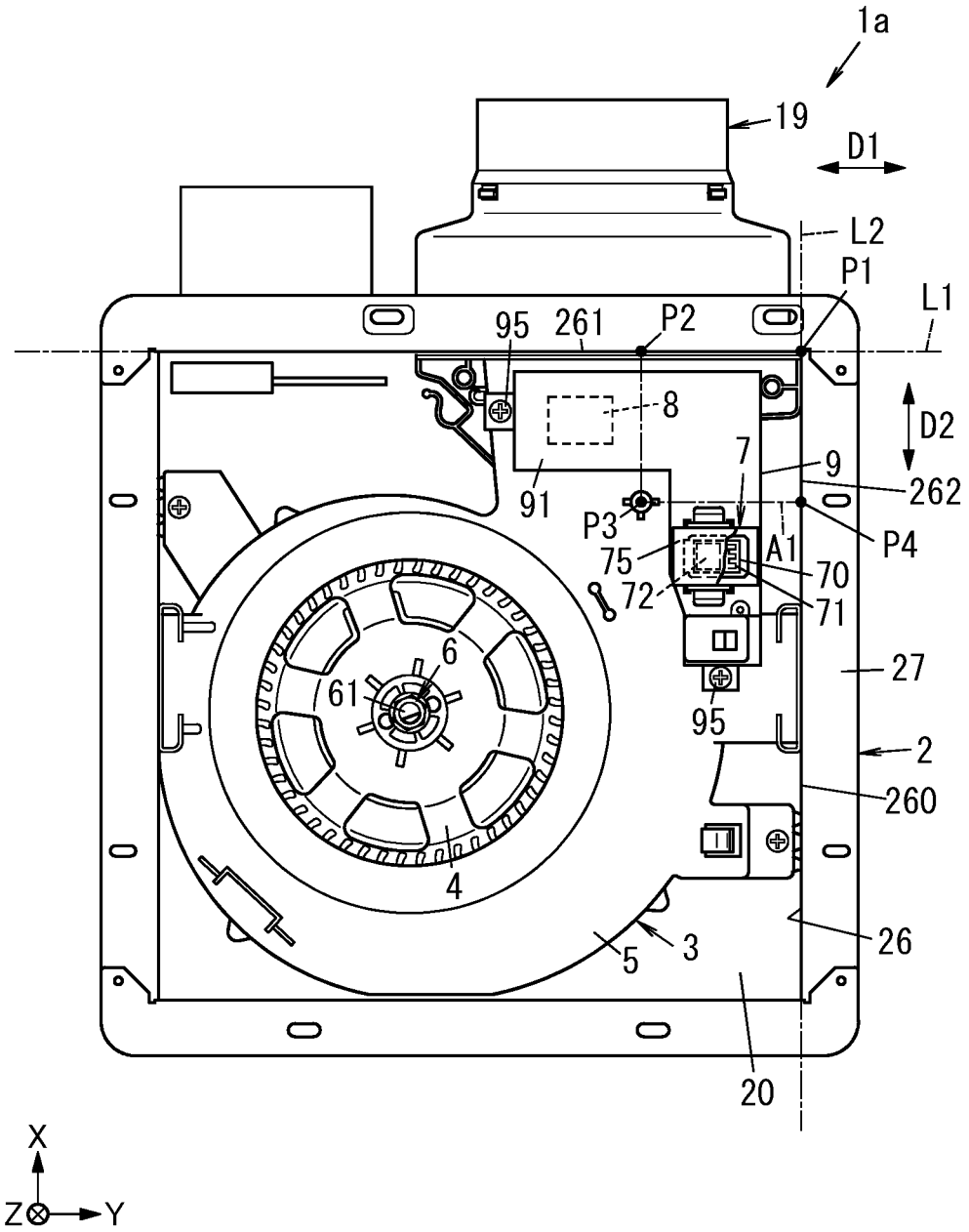
FIG. 10 is a bottom view of a ventilation device according to a comparative example in a state where a cover thereof is removed.

Hereinafter, first, a ventilation device 1*a* according to a comparative example will be described with reference to FIG. 10, and then the communication performance of the wireless communications unit 7 of the ventilation device 1 according to the embodiment will be described with reference to FIGS. 7 to 9. Regarding the ventilation device 1*a* according to the comparative example, elements similar to those of the ventilation device 1 according to the embodiment are assigned with same reference signs, and the explanations thereof are appropriately omitted.

Figure 11:
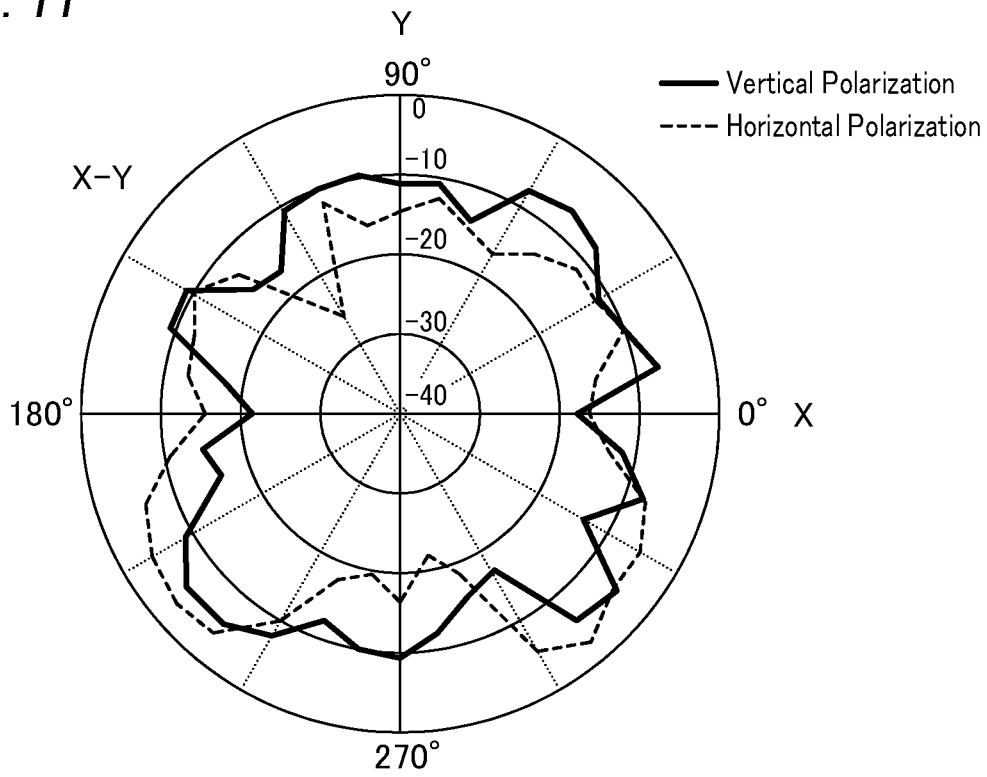
FIG. 11 is a characteristic diagram in X-Y directions, of a wireless communications unit of the ventilation device according to the comparative example.
Figure 12:
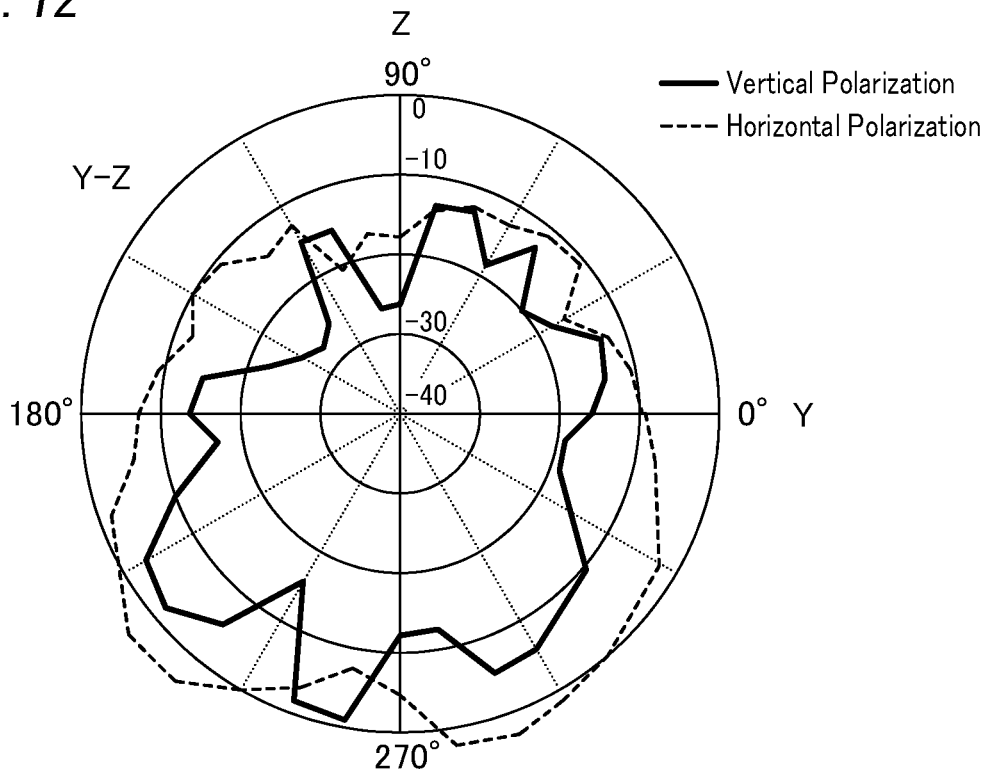
FIG. 12 is a characteristic diagram in Y-Z directions, of the wireless communications unit of the ventilation device according to the comparative example.
Figure 13:
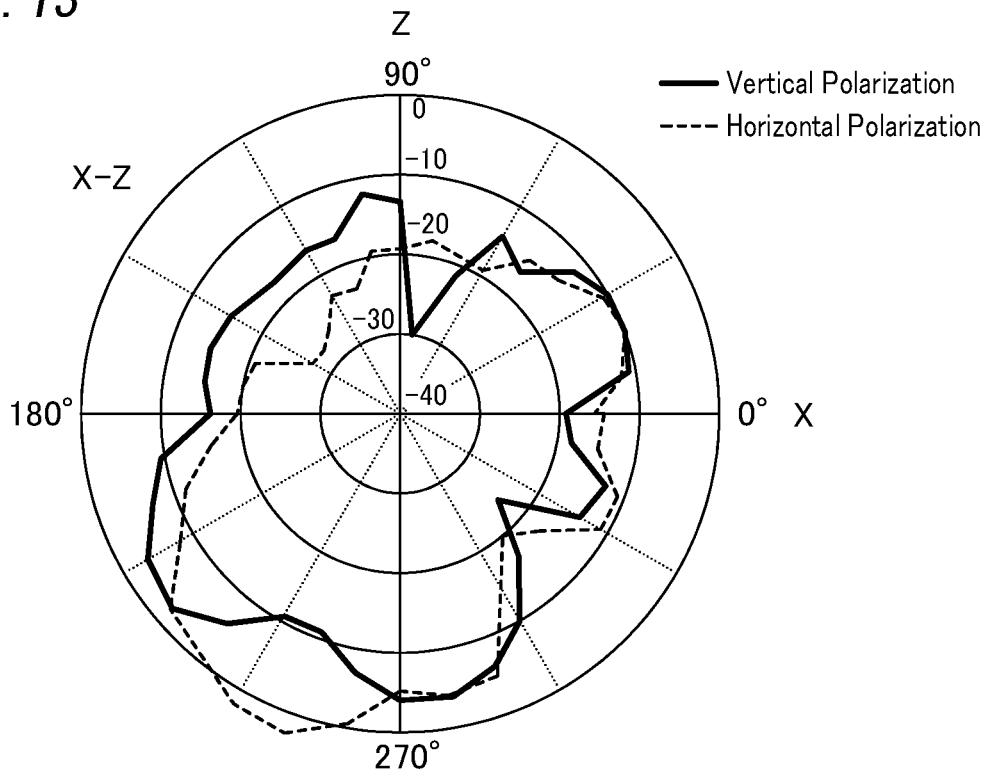
FIG. 13 is a characteristic diagram in X-Z directions, of the wireless communications unit of the ventilation device according to the comparative example.

The ventilation device 1*a* according to the comparative example is different from the ventilation device 1 according to the embodiment in that a wireless communications unit 7 of the ventilation device 1*a* is disposed outside a rectangular/square area A1 when the main body case 2 is viewed from below. To explain the communication performance of the wireless communications unit 7 of the ventilation device 1*a* according to the comparative example, the rectangular coordinates, which are the same as the rectangular coordinates in the lower left of FIG. 3, are shown also in the lower left of FIG. 7. FIGS. 11 to 13 show the communication performance of the wireless communications unit 7 of the ventilation device 1*a* according to the comparative example.

Figure 7:
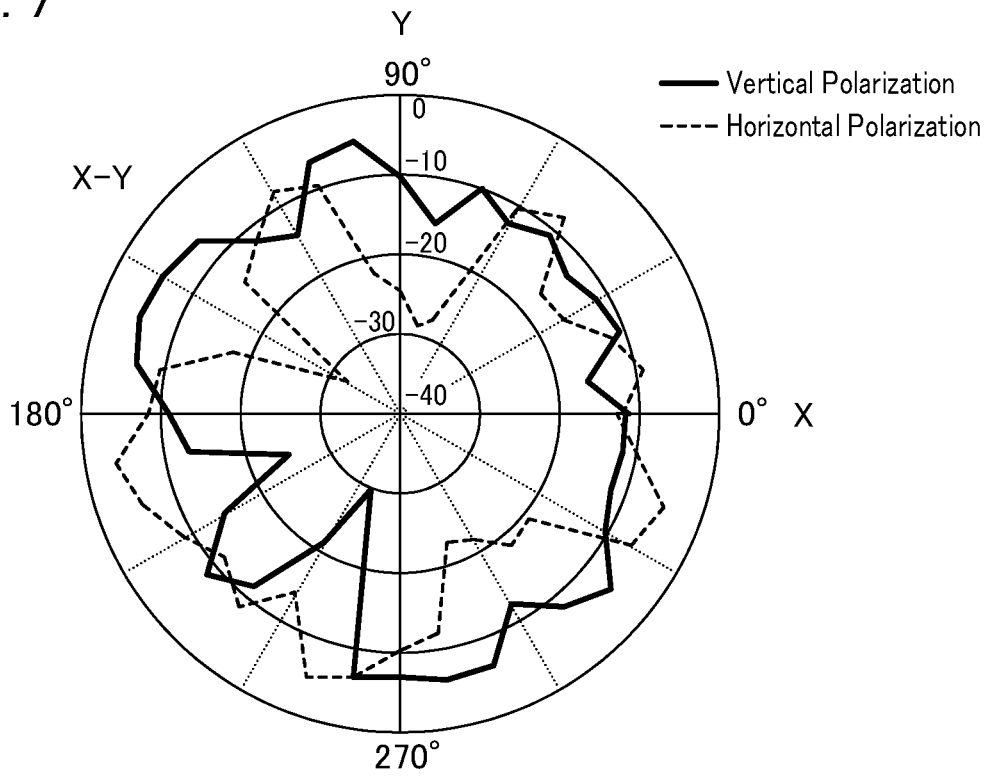
FIG. 7 is a characteristic diagram in X-Y directions, of a wireless communications unit of the ventilation device.

Each of FIGS. 7 and 11 shows communication characteristics in a plane including the X-axis and the Y-axis. Each of FIGS. 8 and 12 shows communication characteristics in a plane including the Y axis and the Z axis. Each of FIGS. 9 and 13 shows communication characteristics in a plane including the X axis and the Z axis. In each of FIGS. 7 to 9, 11 to 13, a thick solid line shows characteristics of vertical polarization, and a dashed line shows characteristics of horizontal polarization.

From FIGS. 7 to 9 and 11 to 13, it is understood that the wireless communications unit 7 of the ventilation device 1 according to the embodiment can further improve the communication performance in the downward direction (i.e., the negative direction of the Z-axis), compared with the ventilation device 1*a* according to the comparative example. Specifically, in the wireless communications unit 7 of the ventilation device 1*a* according to the comparative example, the average gain (antenna efficiency) in the negative direction of the Z-axis is −4.0 dB. On the other hand, in the wireless communications unit 7 of the ventilation device 1 according to the embodiment, the average gain in the negative direction of the Z-axis is −2.1 dB. In this case, the average gain of the embodiment is about 1.5 times that of the comparative example. Accordingly, the wireless communications unit 7 of the ventilation device 1 according to the embodiment can further improve the communication performance below the main body case 2, compared with the wireless communications unit 7 of the ventilation device 1*a* according to the comparative example.

Thus, the ventilation device 1 according to the embodiment can further improve the communication performance in the downward direction (i.e., the negative direction of the Z-axis), compared with the ventilation device 1*a* according to the comparative example. Therefore, the ventilation device 1 can further enhance the user convenience, compared with the ventilation device 1*a* according to the comparative example.

(5) Advantages

In the ventilation device 1 according to the embodiment, the wireless communications unit 7 includes the antenna 71 and performs the wireless communication by using the radio wave of the prescribed wavelength as the medium. When the main body case 2 is viewed from below (the lower side of the main body case 2), the antenna 71 is within the rectangular/square area (i.e., a rectangular area, or a square area) A1 defined by the first to fourth points P1 to P4. The first point P1 is defined as the intersection of the first straight line L1 (including the first edge 261 linearly along the first direction D1, of the opening edge 260 of the first opening 26) and the second straight line L2 (including the second edge 262 linearly along the second direction D2 perpendicular to the first direction D1, of the opening edge 260 of the first opening 26). The second point P2 is defined as a point apart from the first point P1 in the first direction D1 by the distance that is half the prescribed wavelength. The third point P3 is defined as a point apart from the second point P2 in the second direction D2 by the distance that is half the prescribed wavelength. The fourth point P4 is defined as a point apart from the first point P1 in the second direction D2 by the distance that is half the prescribed wavelength.

In the ventilation device 1 according to the embodiment, when the main body case 2 is viewed from below, the wireless communications unit 7 is within the rectangular/square area A1, which can improve the communication performance.

(6) Variations of Embodiment

The embodiment described above is merely one of various exemplary embodiments of the present disclosure. The embodiment described above may be readily modified in various manners depending on the design or any other factor, as long as the purpose of the present disclosure can be achieved.

The ventilation device 1 is implemented as an exhaust device that exhausts the indoor air outdoor, but should not be construed as limiting. The ventilation device 1 may be implemented as an air supply device that supplies the outdoor air indoor.

The main body case 2 includes the second opening 28 in the peripheral wall 25, but should not be construed as limiting. Alternatively, the main body case 2 may include a second opening 28 in the upper wall 20. Alternatively, the main body case 2 may include a second opening 28 in a center of the first side wall 21 in the first direction D1.

The opening shape of the first opening 26 of the main body case 2 is not limited to be strictly rectangular (or strictly square), but may be almost rectangular (or almost square). In the ventilation device 1, when the main body case 2 is viewed from below, the first corner C1 may be rounded.

In the ventilation device 1, the surface treatment may be appropriately applied to the main body case 2. Examples of the surface treatments include painting, plating, alumite treatment, and coating.

In the ventilation device 1, the central portion 17 of the cover 10 may be implemented as an LED unit that illuminates a space below the ventilation device 1.

In the air blowing unit 3, the rotary shaft 61 of the motor 6 is directly connected to the fan 4 but should not be construed as limiting. Alternatively, the rotary shaft 61 may be indirectly connected to the fan 4.

In the ventilation device 1, the controller 8 may control the air blowing unit 3 based on an output of a sensor. The sensor may be, for example, an air quality sensor configured to detect at least one of temperature, humidity, and $CO_2$ concentration. The sensor may be provided in ventilation device 1, or may not be provided in the ventilation device 1.

The ventilation device 1 may further include an air filter disposed between the cover 10 and the first opening 26. The air filter may be, for example, a High Efficiency Particulate Air Filter (HEPA Filter).

In the ventilation system 100 according to the embodiment, the information terminal 103 is not a component element of the ventilation system 100 but should not be construed as limiting. Alternatively, the ventilation system 100 may include the information terminal 103, as a component element of the ventilation system 100.

In the ventilation system 100 according to the embodiment, the repeater 102 is not a component element of the ventilation system 100 but should not be construed as limiting. Alternatively, the ventilation system 100 may include the repeater 102, as a component element of the ventilation system 100.

(Aspect)

This specification discloses the following aspects.

A ventilation device (1) according to a first aspect includes a main body case (2), an air blowing unit (3), a wireless communications unit (7), and a controller (8). The main body case (2) is made of metal. The main body case (2) has a rectangular or square box shape, and includes a first opening (26) and a second opening (28), the first opening (26) is in a lower surface of the main body case (2), and the second opening (28) is in a peripheral wall (25) or an upper wall (20) of the main body case (2). The air blowing unit (3) is disposed in the main body case (2). The air blowing unit (3) is configured to blow air between the first opening (26) and the second opening (28). The wireless communications unit (7) includes an antenna (71), and is configured to perform wireless communication by using a radio wave having a prescribed wavelength as a medium. The controller (8) is connected to the wireless communications unit (7). The controller (8) is configured to control the air blowing unit (3) in accordance with a signal received by the wireless communications unit (7). When the main body case (2) is viewed from below, the antenna (71) is within a rectangular/square area defined by a first point (P1), a second point (P2), a third point (P3) and a fourth point (P4), and is disposed apart from an opening edge (260) of the first opening (26) of the main body case (2). The opening edge (260) of the first opening (26) includes: a first edge (261) linearly along a first direction (D1); and a second edge (262) linearly along a second direction (D2) perpendicular to the first direction (D1), the first point (P1) is defined as an intersection of a first straight line (L1) and a second straight line (L2), the first straight line (L1) includes the first edge (261), and the second straight line (L2) includes the second edge (262). The second point (P2) is defined as a point apart from the first point (P1) in the first direction (D1) by a distance that is half the prescribed wavelength. The third point (P3) is defined as a point apart from the second point (P2) in the second direction (D2) by a distance that is half the prescribed wavelength. The fourth point (P4) is defined as a point apart from the first point (P1) in the second direction (D2) by a distance that is half the prescribed wavelength.

The ventilation device (1) according to the first aspect can realize performing wireless communication and further contribute to improving communication performance.

In a ventilation device (1) according to a second aspect, which may be implemented in conjunction with the first aspect, the air blowing unit (3) includes a fan case (5), a fan (4), and a motor (6). The fan case (5) is made of resin. The fan case (5) includes a third opening (56) connected to the first opening (26) and a fourth opening (58) connected to the second opening (28). The fan (4) is made of resin. The fan (4) is disposed in the fan case (5). The motor (6) includes a rotary shaft (61), and is despised to rotate the fan (4) together with the rotary shaft (61).

The ventilation device (1) according to the second aspect can prevent the fan case (5) from affecting a communication state of the wireless communications unit (7).

In a ventilation device (1) according to a third aspect, which may be implemented in conjunction with the second aspect, the fan (4) is a centrifugal fan. The opening edge (260) of the first opening (26) includes: a first corner (C1) including the first point (P1); and a second corner (C2) arranged diagonally to the first corner (C1). When the main body case (2) is viewed from below, the rotary shaft (61) of the motor (6) is disposed to be closer to the second corner (C2) than a center (E3) of a diagonal line (L3) connecting the first corner (C1) and the second corner (C2) is.

In the ventilation device (1) according to the third aspect, the fan case (5) can be compactly accommodated in the main body case (2), which can prevent the size of the main body case (2) from being increased.

A ventilation device (1) according to a fourth aspect, which may be implemented in conjunction with the third aspect, further includes a holding member (9). The holding member (9) holds the controller (8) and the wireless communications unit (7). The holding member (9) is attached to the fan case (5). When the main body case (2) is viewed from below, the holding member (9) is positioned to be closer to the first corner (C1) than the center (E3) of the diagonal line (L3) is.

In the ventilation device (1) according to the fourth aspect, the fan case (5) can be compactly accommodated in the main body case (2), which can make the holding member (9) locate near the first corner (C1).

In a ventilation device (1) according to a fifth aspect, which may be implemented in conjunction with any one of the first to fourth aspects, the first opening (26) is a suction port, and the second opening (28) is an exhaust port. The air blowing unit (3) is configured to send, to the second opening (28), air sucked form the first opening (26).

The ventilation device (1) according to the fifth aspect can be used as an exhaust device.

A ventilation device (1) according to a sixth aspect, which may be implemented in conjunction with any one of the first to fifth aspects, further includes a cover (10). The cover (10) is made of resin. The cover (10) is disposed to cover the first opening (26) of the main body case (2), and has a vent opening (16) connected to the first opening (26).

The ventilation device (1) according to the sixth aspect can contribute to improving communication performance.

In a ventilation device (1) according to a seventh aspect, which may be implemented in conjunction with any one of the first to sixth aspects, the peripheral wall (25) includes: a first side wall (21) corresponding to the first edge (261); and a second side wall (22) corresponding to the second edge (262). The main body case (2) has the second opening (28) in the first side wall (21). The ventilation device (1) further includes a duct connector (19). The duct connector (19) is made of metal. The duct connector (19) has a tubular shape, and has an inner space connected to the second opening (28). The duct connector (19) is disposed on an outer surface of the first side wall (21).

The ventilation device (1) according to the seventh aspect can prevent the duct connector (19) from affecting a communication state of the wireless communications unit (7).

A ventilation system (100) according to an eighth aspect includes the ventilation device (1) according to any one of the first to seventh aspects, and an apparatus (master device 101). The apparatus (master device 101) is configured to perform wireless communication with the wireless communications unit (7) of the ventilation device (1).

The ventilation system (100) according to the eighth aspect can realize performing wireless communication and further contribute to improving communication performance.

REFERENCE SIGNS LIST

1 Ventilation Device
2 Main Body Case
20 Upper Wall
21 First Side Wall
22 Second Side Wall
23 Third Side Wall
24 Fourth Side Wall
25 Peripheral Wall
26 First Opening
260 Opening Edge
261 First Edge
262 Second Edge
28 Second Opening
3 Air Blowing Unit
4 Fan
5 Case
56 Third Opening
58 Fourth Opening
6 Motor
61 Rotary Shaft
7 Wireless Communications Unit
71 Antenna
10 Cover
16 Vent Opening
19 Duct Connector
100 Ventilation System
101 Master Device (Apparatus)
A1 Rectangular/square Area
C1 First Corner
C2 Second Corner
D1 First Direction
D2 Second Direction
E3 Center
P1 First Point
P2 Second Point
P3 Third Point
P4 Fourth Point
L1 First Straight Line
L2 Second Straight Line
L3 Diagonal Line

The invention claimed is:

1. A ventilation device, comprising:

a main body case made of metal and having a rectangular or square box shape, the main body case including a first opening and a second opening, the first opening being in a lower surface of the main body case, and the second opening being in a peripheral wall or an upper wall of the main body case;

an air blowing unit disposed in the main body case, and configured to blow air between the first opening and the second opening;

a wireless communications unit including an antenna, and configured to perform wireless communication by using a radio wave having a prescribed wavelength as a medium; and a controller connected to the wireless communications unit, and configured to control the air blowing unit in accordance with a signal received by the wireless communications unit, when the main body case is viewed from below, the antenna being within a rectangular/square area defined by a first point, a second point, a third point and a fourth point, the antenna being disposed apart from an opening edge of the first opening of the main body case, the opening edge including:

a first edge linearly along a first direction; and a second edge linearly along a second direction perpendicular to the first direction, the first point being defined as an intersection of a first straight line and a second straight line, the first straight line including the first edge, the second straight line including the second edge, the second point being defined as a point apart from the first point in the first direction by a distance that is half the prescribed wavelength, the third point being defined as a point apart from the second point in the second direction by a distance that is half the prescribed wavelength, and the fourth point being defined as a point apart from the first point in the second direction by a distance that is half the prescribed wavelength.

2. The ventilation device of claim 1, wherein the air blowing unit includes:

a fan case made of resin, and including a third opening connected to the first opening and a fourth opening connected to the second opening;

a fan made of resin, and disposed in the fan case; and a motor including a rotary shaft, and disposed to rotate the fan together with the rotary shaft.

3. The ventilation device of claim 2, wherein the air blowing unit includes, as the fan, a centrifugal fan, the opening edge of the first opening includes: a first corner including the first point; and a second corner arranged diagonally to the first corner, when the main body case is viewed from below, the rotary shaft of the motor is disposed to be closer to the second corner than a center of a diagonal line connecting the first corner and the second corner is.

4. The ventilation device of claim 3, further comprising a holder that holds the controller and the wireless communications unit, wherein the holder is attached to the fan case, and when the main body case is viewed from below, the holder is positioned to be closer to the first corner than the center of the diagonal line is.

5. The ventilation device of claim 1, wherein the first opening is a suction port, the second opening is an exhaust port, and the air blowing unit is configured to send, to the second opening, air sucked form the first opening.

6. The ventilation device of claim 1, further comprising a cover made of resin, wherein the cover is disposed to cover the first opening of the main body case, and has a vent opening connected to the first opening.

7. The ventilation device of claim 1, wherein the peripheral wall includes:

a first side wall corresponding to the first edge; and a second side wall corresponding to the second edge, the main body case has the second opening in the first side wall, the ventilation device further comprises a duct connector made of metal and having a tubular shape, the duct connector has an inner space connected to the second opening and is disposed on an outer surface of the first side wall.

8. A ventilation system, comprising:

the ventilation device of claim 1; and an apparatus configured to perform wireless communication with the wireless communications unit of the ventilation device.

* * * * *